US012558590B2

(12) United States Patent
Dunbar et al.

(10) Patent No.: US 12,558,590 B2
(45) Date of Patent: Feb. 24, 2026

(54) MULTI-PURPOSE WEIGHT BAR WITH ADJUSTABLE HANDLES

(71) Applicant: .50 Cal Fitness, LLC, Edna, TX (US)

(72) Inventors: Derek J. Dunbar, Edna, TX (US); Cody W. Engelmohr, Louise, TX (US); Zachary T. Hall, New Kensington, PA (US)

(73) Assignee: .50 Cal Fitness, LLC, Edna, TX (US)

( * ) Notice: Subject to any disclaimer, the term of this patent is extended or adjusted under 35 U.S.C. 154(b) by 42 days.

(21) Appl. No.: 18/420,342

(22) Filed: Jan. 23, 2024

(65) Prior Publication Data

US 2024/0366994 A1 Nov. 7, 2024

Related U.S. Application Data

(60) Provisional application No. 63/464,569, filed on May 6, 2023.

(51) Int. Cl.
*A63B 21/00* (2006.01)
*A63B 21/072* (2006.01)

(52) U.S. Cl.
CPC ..... *A63B 21/4035* (2015.10); *A63B 21/0724* (2013.01); *A63B 2225/09* (2013.01)

(58) Field of Classification Search
CPC ..... A63B 21/4035; A63B 21/0724; A63B 2225/09
See application file for complete search history.

(56) References Cited

U.S. PATENT DOCUMENTS

| | | | | | |
|---|---|---|---|---|---|
| 4,743,018 | A * | 5/1988 | Eckler | A63B 21/075 | 482/106 |
| 8,951,170 | B1 * | 2/2015 | Tayo | A63B 21/0728 | 482/139 |
| D898,134 | S * | 10/2020 | Hitman | D21/679 | |
| D1,061,756 | S * | 2/2025 | Pritchett | D21/679 | |
| D1,064,130 | S * | 2/2025 | Brown | D21/681 | |
| D1,065,375 | S * | 3/2025 | Pritchett | D21/679 | |
| 2020/0289870 | A1 * | 9/2020 | Olmstead | A63B 23/03525 | |
| 2021/0154523 | A1 * | 5/2021 | Hitman | A63B 23/1236 | |
| 2023/0173332 | A1 * | 6/2023 | Bauerle | A63B 21/0724 | 482/115 |
| 2023/0241445 | A1 * | 8/2023 | Garcia | A63B 21/4035 | 482/106 |
| 2024/0198165 | A1 * | 6/2024 | Hitman | A63B 21/0724 | |
| 2024/0316388 | A1 * | 9/2024 | Nolan | A63B 21/0724 | |
| 2024/0366994 | A1 * | 11/2024 | Dunbar | A63B 21/0724 | |

* cited by examiner

*Primary Examiner* — Joshua T Kennedy
(74) *Attorney, Agent, or Firm* — Harness, Dickey & Pierce, P.L.C.

(57) ABSTRACT

A multi-functional weight bar assembly including selectively repositionable handles to carry out various weight lifting exercises with a single bar is presented. The weight bar may include an opening to accommodate the user's upper torso if desired during certain exercises allowing the weight to be positioned lower than normal. By moving the handles inwardly or outwardly along the weight bar or angling the handles as desired, various muscle groups can be targeted with a single weight bar assembly.

19 Claims, 8 Drawing Sheets

MULTI-PURPOSE WEIGHT BAR WITH ADJUSTABLE HANDLES

CROSS-REFERENCE TO RELATED APPLICATIONS

This application claims the benefit of U.S. Provisional Application No. 63/464,569, filed on May 6, 2023. The entire disclosure of the above application is incorporated herein by reference.

FIELD

The present disclosure relates to a multi-purpose weight bar for carrying out various weight based exercises utilizing a single bar assembly. By way of a non-limiting example the bar may be used for chest and shoulder presses as well as upper back pull exercises.

BACKGROUND

Currently, those interested in a broad range of weight based exercises and particularly those interested in working out the chest, shoulders or upper back effectively would likely need to employ a number of different weight bars having varying shapes and sizes. Among the types of bars employed are standard (straight) bars, cambered bars, curl bars, and Swiss bars, otherwise known as football bars to name a few. Each of these bars are largely designed for exercising certain muscle groups or at least are not designed in a manner to effectively exercise a variety of muscle groups. Further, it can be both expensive and time consuming to utilize multiple types of bars during a workout.

SUMMARY

Thus, there is a need for a multi-purpose weight bar assembly capable of effective use for a variety of weight lifting exercises. The weight bar assembly is formed from a high strength steel or aluminum alloy, for example, capable of supporting weight loads of up to about 500 lbs.

Among the key features of the present invention is a bar body including spaced apart legs and under one embodiment having an offset central portion forming an open area wide enough to allow for the weights extending from opposite ends of the bar to be positioned lower than the user's chest. Another key feature includes one or more selectively adjustable handles transversely disposed between the spaced apart beams. By moving the handle from a relatively perpendicular position to one or more angled positions, different weight lifting exercises can be carried out, as will be described in more detail below. Another advantage to having adjustable handles is the opportunity to position them in a manner to limit muscle strains during a workout session.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Figure 1:
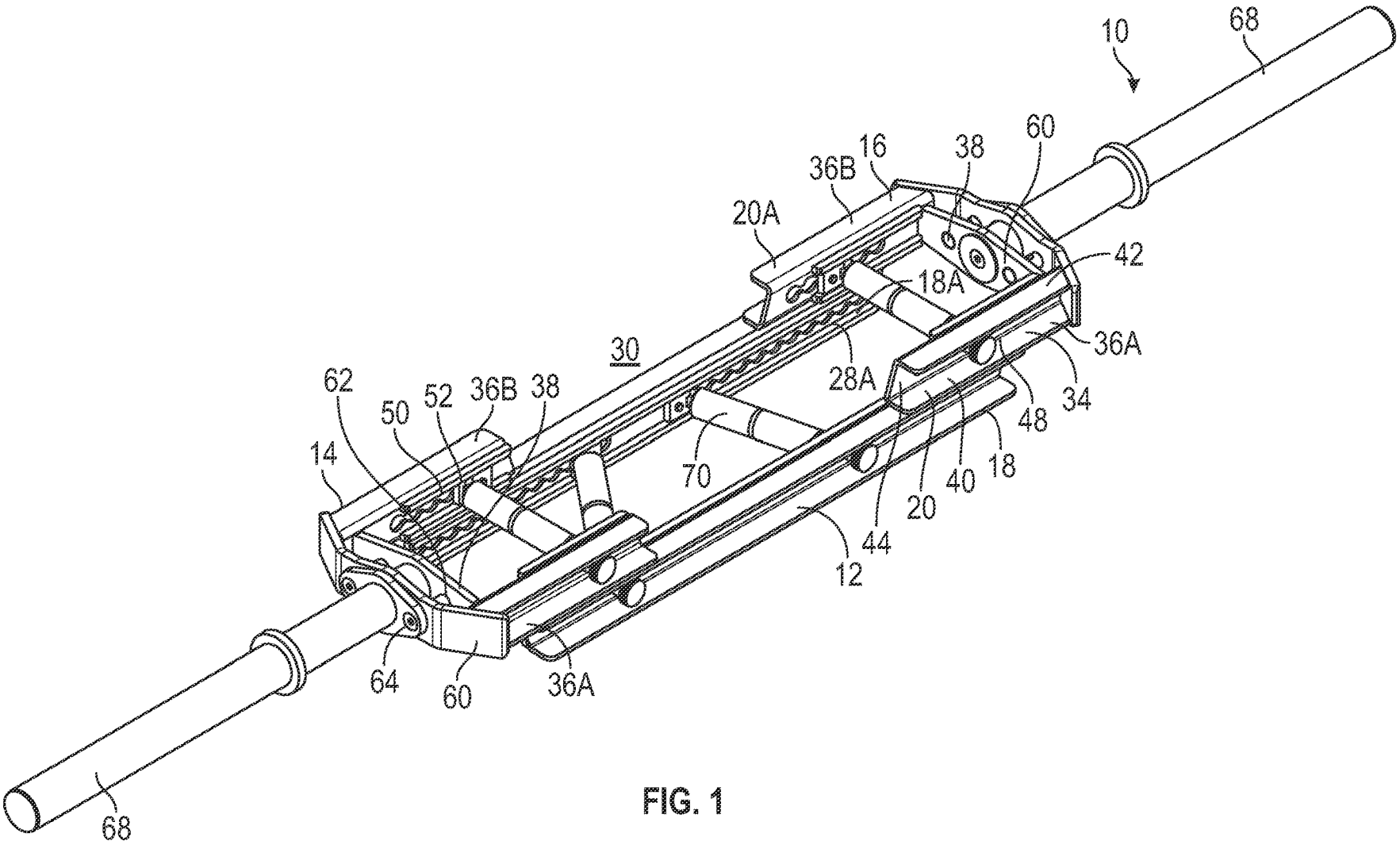
FIG. 1 is a bottom perspective view of a weight bar assembly embodiment of the present invention.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

Figure 2:
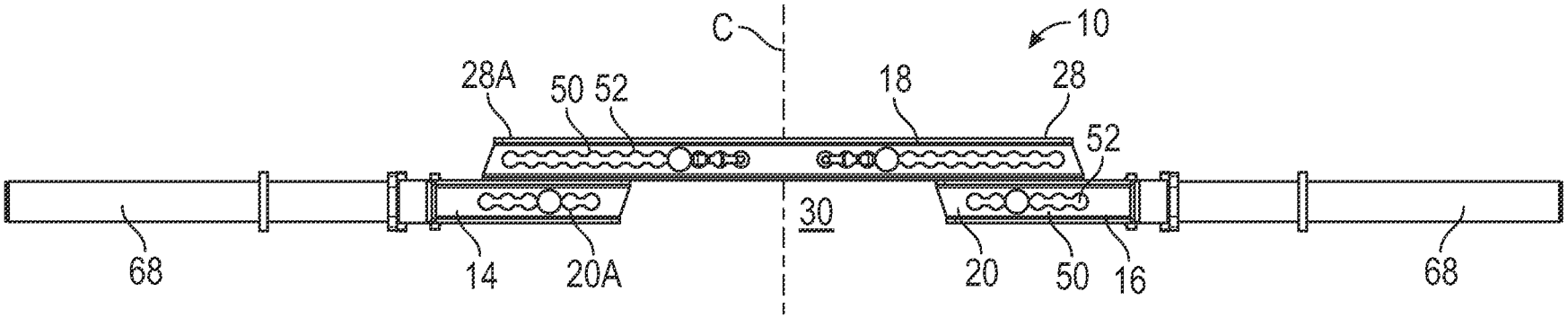
FIG. 2 is a side view of the weight bar assembly of FIG. 1 shown in an alternate orientation.

Referring to FIGS. 1-2, a first multi-purpose weight bar assembly 10 embodiment is presented in accordance with the teachings of the present invention. The weight bar assembly 10 generally includes a body 12 having a first bar segment 14 and a spaced apart second bar segment 16 coupled together by a third bar segments 18, 18A which are disposed in an offset position relative to the first and second bar segments. The offset is accomplished by stacking end portions 28, 28A of the third bar segments over end portions 20, 20A of the first and second bar segments respectively. By stacking the end portions, an open area 30 is provided between the end portions of the first and second bar segments whereby the opening is sufficient to accommodate the upper torso of a person using the weight bar assembly. The third bars 18A, 18A may also have an I-beam like configuration formed by a top wall 40, a bottom wall 42, and a centrally disposed transverse wall 44. As with the first and second bars, the third bars also preferably include the slots 50 and notches 52 for hosting handle assemblies 70.

As should be clear from reviewing FIGS. 1-2, the first bar segment 14 and second bar segment 16 are identical in structure. Accordingly, when reference is made to either the first bar or second bar segments, it should be understood that the same description applies to the other. Thus, each of the first and second spaced apart bar segments 14, 16 have an overall substantially u-shaped body 34 including first and second legs 36A, 36B which are connected by a cross-member 38. Since the first and second bar segments are mutually opposing, the legs thereof extend toward the legs of the opposing bar segments. Each of the first and second legs have a top wall 40, a bottom wall 42 and a transverse wall 44 connecting them. The transverse walls include at least one slot 52 for receiving handle fasteners as will be described in greater detail below. The slot 52 may include a plurality of notches 50 which expand portions of the slot. As can be seen, the overall shape of the top wall, bottom wall, and transverse wall in combination define an elongated recess 48 for hosting the end of a portion of the handle assembly 70. Still further, the top wall, bottom wall, and transverse wall may have an I-beam type construction thereby having elongated recesses on opposing sides of the transverse wall. Extending from each end wall in the direction opposite of the first and second legs is a weight support post or rod 68 for hosting free weights thereon. The weight bar assembly may also include and end cap 60 attached proximate to the ends of the cross-member 38 and spaced apart therefrom along a central portion to provide further structural support for the weight support post. Bushings 62 extending between the cross-member 38 and the end cap 60 may be provided. The bushings, if present, may host a fastener 64 for securing the optional but preferred end cap.

Figure 3:
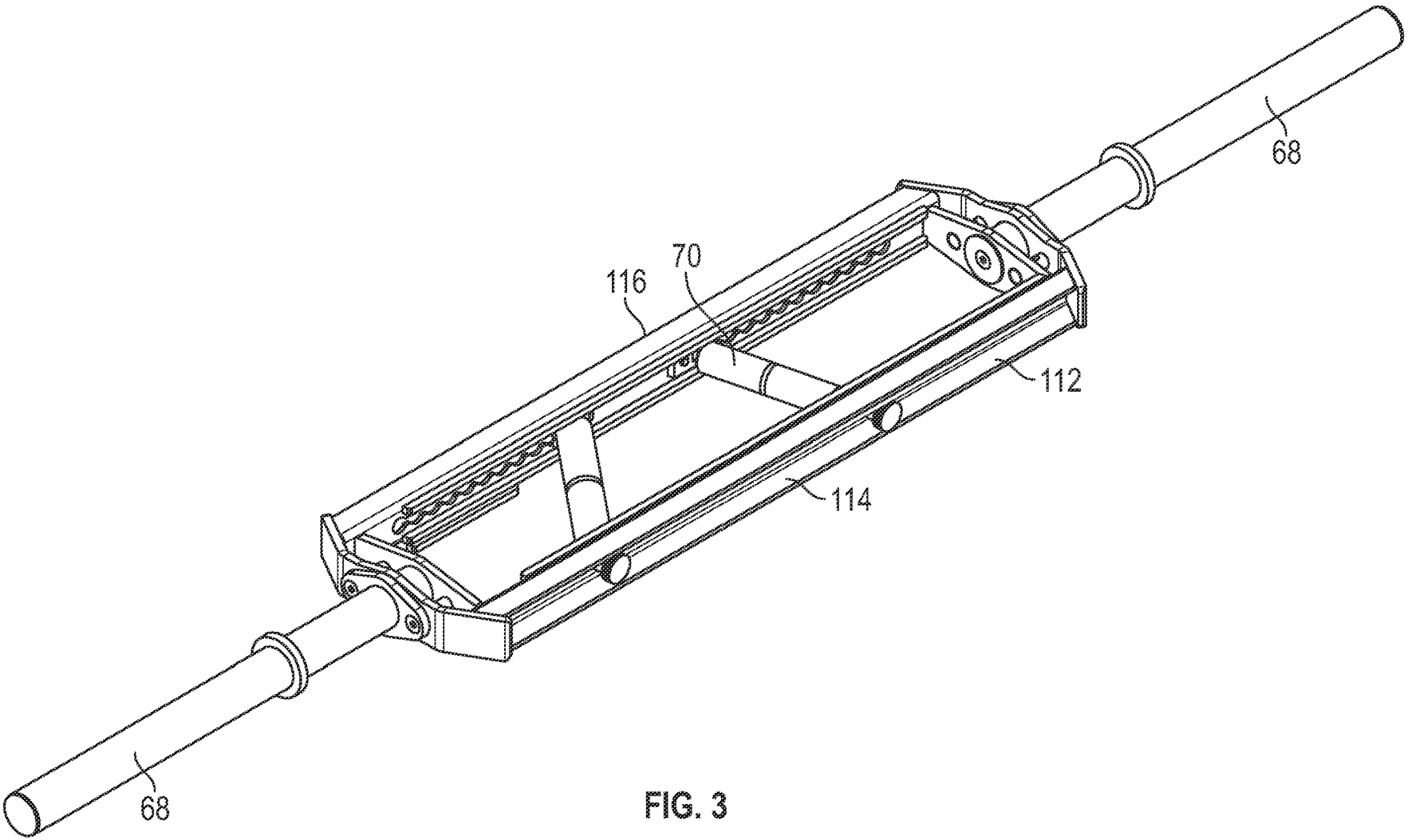
FIG. 3 is a perspective view of a second weight bar assembly embodiment of the present invention.

FIG. 3 demonstrates an alternative weight bar embodiment. Under this embodiment, the weight bar assembly 10 is linear. Thus, the first and second spaced apart bar segments 114, 116 are continuous and can be defined by a centerpoint C. As such, the above noted third bars are eliminated and as a result no offset is present. All other structural features of FIGS. 1-2, except for those of the third bars, are present under this embodiment.

Figure 4:
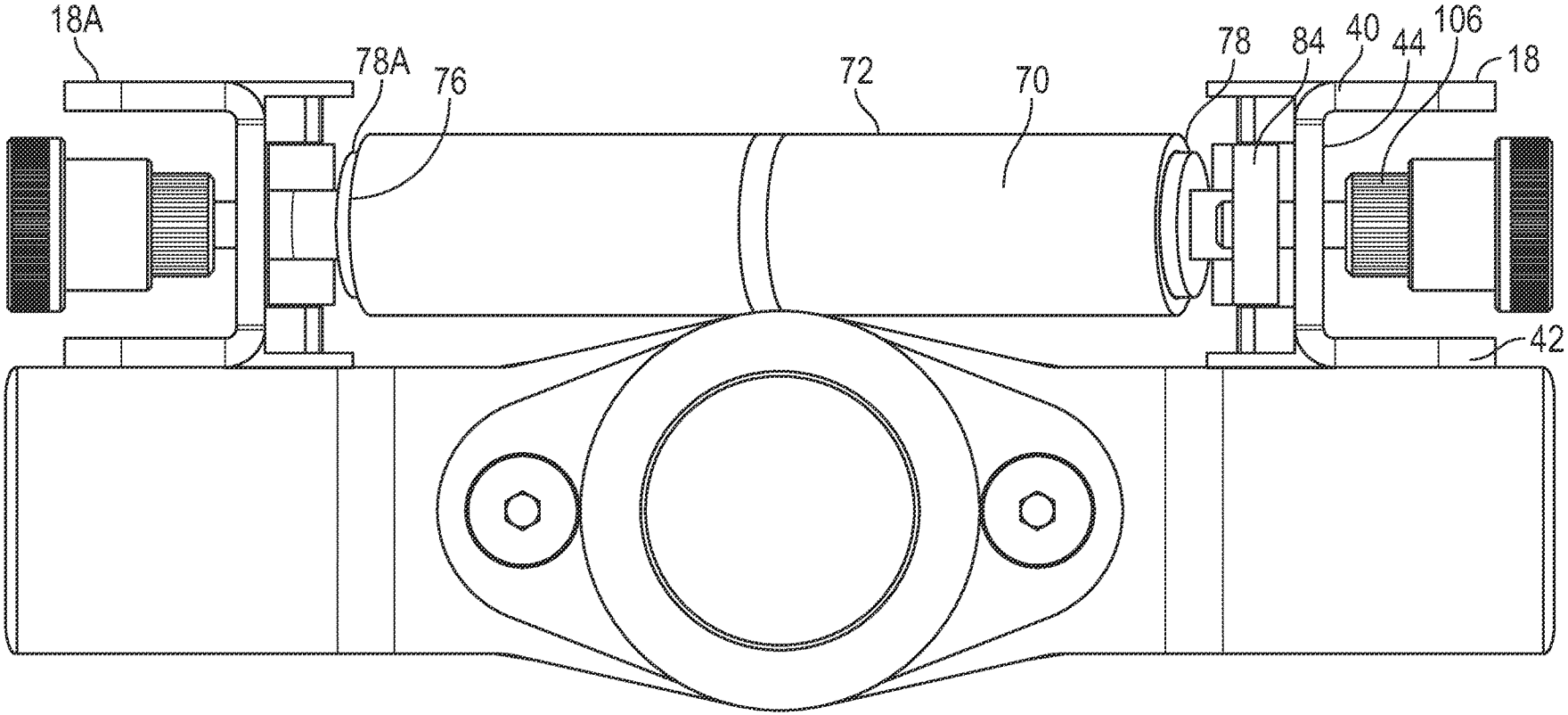
FIG. 4 is an end view of the weight bar assembly of FIG. 1 having a handle assembly attached.
Figure 5:
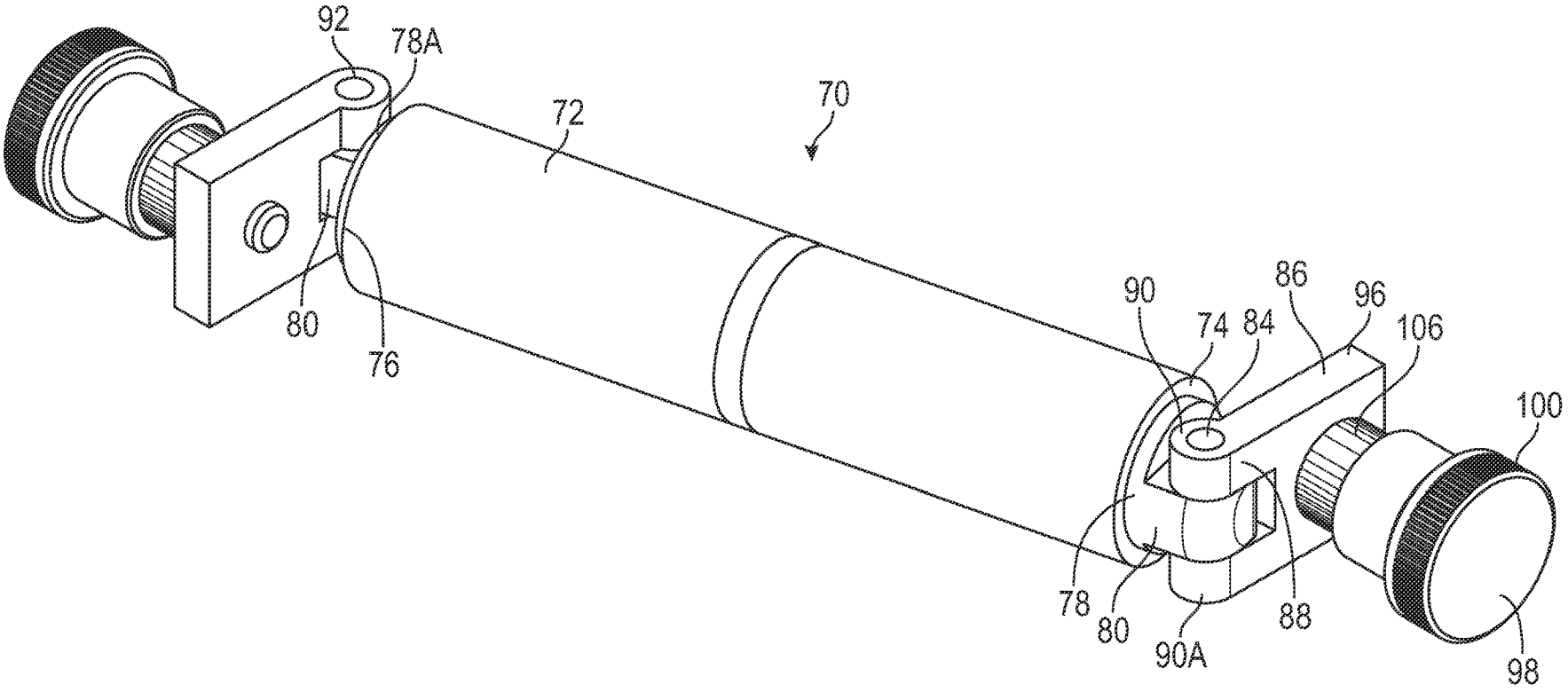
FIG. 5 is a perspective view of a handle of the present invention.
Figure 6:
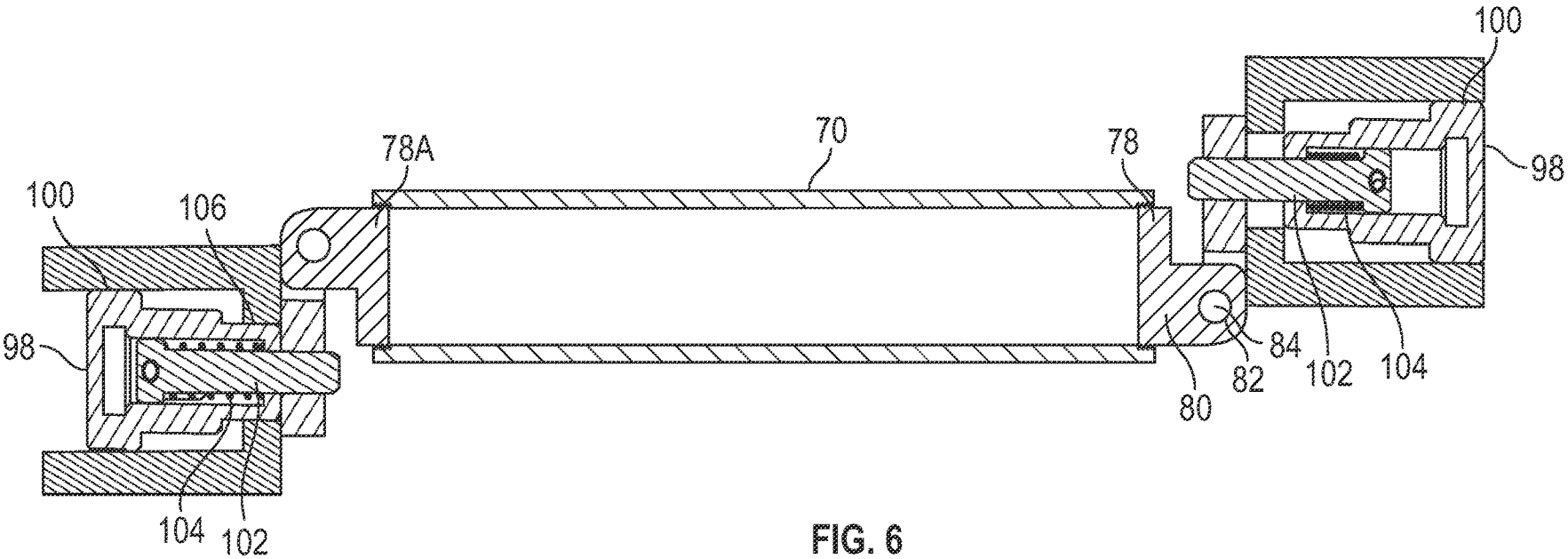
FIG. 6 is a cross-sectional view of the handle of FIG. 5.
Figure 7A:
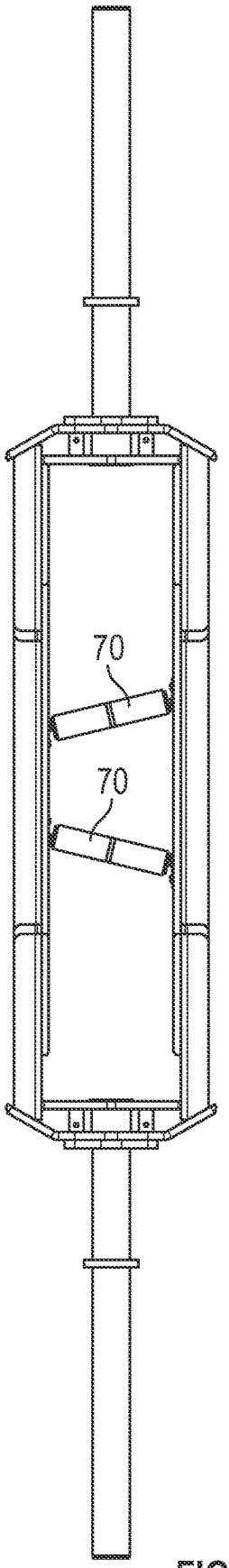
FIGS. 7A-7C are top views of handle configurations shown in varying positions along a weight bar assembly.
Figure 7B:
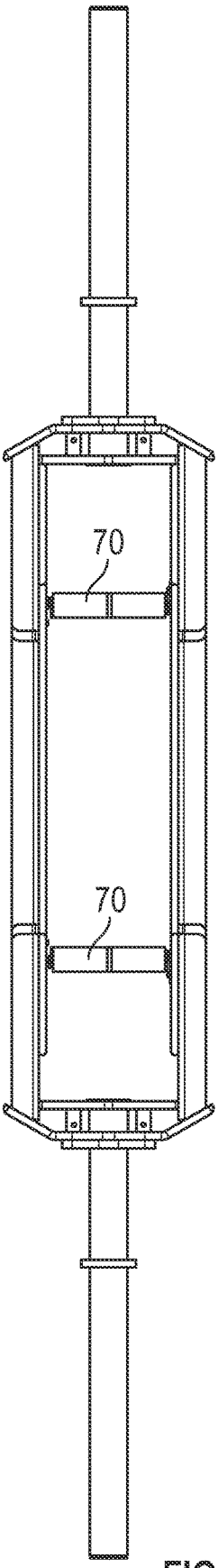
Figure 7C:
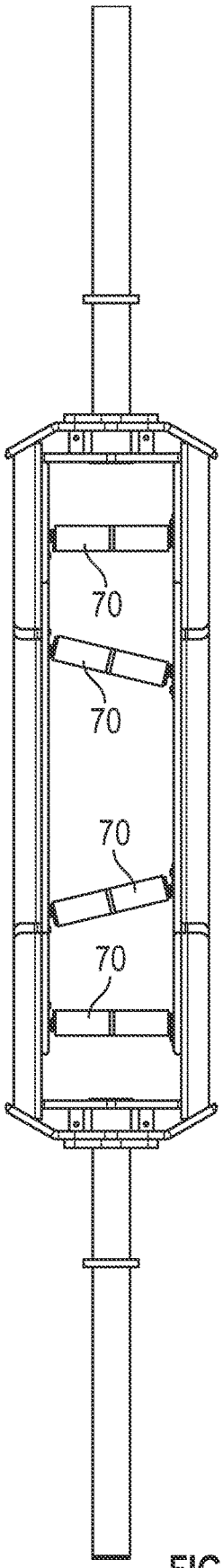

Referring to FIGS. 4-6, handles 70 useful in conjunction with the different weight bar assemblies disclosed herein are presented. The handles 70 are designed in a manner which allows them to be repositioned along the weight bar segments as desired. As seen, for example, in FIGS. 7A-7C, depending on the intended weight lifting exercise, the handles can be selectively adjusted along the first and second bars and/or along the third bars when present. The handles 70 generally include a grip 72 which may have a cylindrical body, for example. The grip includes a first end 74 and a second end 76 with each end including an end cap 78, 78A. The end caps may be integrally formed as part of the handle or may be attached thereto, such as by a threaded engagement as best shown in FIG. 6. The end caps 78, 78A include a ringlet 80 having an opening 82 for receiving a pivot pin 84.

Attached over the ringlets are coupling members 84. The coupling members may include a rotatable link 86 having a yolk 88 defined by first and second legs 90, 90A having holes 92 extending therethrough. The yolk opening is sized to receive the ringlet such that a pin 94 can be inserted through the holes 92. The coupling members also include a panel 96 sized to fit within the recess 48 of a weight bar segment to facilitate attachment and limit lateral movement therein. Disposed along each panel is a spring loaded latch 98. The latch may have many different configurations so long as it can release sufficiently to move the handle assembly to a preferred location along the weight bar. For example, the latch 98 may have a knob 100 disposed over a shaft 102 and a spring 104 contained within the knob. Under this embodiment, one end of the shaft is attached to the panel and the other end is captured within the knob with the central portion of the shaft extending through an elongated slot 50. As the knob is pulled up on the shaft away from the panel, the shaft is exposed so that it can be moved along an elongated slot 50. Once the shaft is in the desired location, the knob is released to spring back toward the panel so that the smaller end 106 of the knob seats within a notch 52 to lock the handle to the weight bar. Employing the handle assemblies described herein, a person using the weight bar can selectively position a plurality of handles in the desired positions to carry out a number of different exercises directed to different muscle groups using a single weight bar assembly. As can be seen with reference to FIGS. 7A-7C, the grips 72 can be disposed perpendicular to the weight bar or can be angled relative thereto to exercise different muscle groups.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A weight bar including one or more selectively adjustable handles, comprising:

a weight bar assembly having an elongated body including a first bar segment and a second bar segment, said bar segments each including first and second legs connected by a cross-member, said cross-member having a weight supporting post extending therefrom;

the one or more selectively adjustable handles each including a first end, a second end, and a grippable portion extending therebetween; and each of the handles having at least one coupling member, said coupling member including a panel pivotably connected to at least one of the first end and the second end of a respective handle and a selectively releasable latch assembly extending from said panel which is connected to the body of the said weight bar assembly;

wherein upon releasing the latch assembly the coupling member and handle can be moved along the body of the weight bar assembly to a desired position.

2. The weight bar of claim 1, wherein each of the first and second legs include a top wall, a bottom wall, and a transverse wall collectively defining an elongated recess, said transverse wall including one or more slots for hosting the respective releasable latch assembly.

3. The weight bar of claim 2, wherein each said latch assembly includes a shaft having a first end connected to a respective said panel and a central portion, a spring disposed over the shaft, and a displaceable knob extending through a slot, disposed over the spring and shaft.

4. The weight bar of claim 3, wherein the slot includes a plurality of spaced apart notches expanding portions of the slot whereby upon displacing the knob the shaft can be moved along the slot and upon releasing the knob a portion of the knob seats within a notch to lock the handle in place relative to the weight bar.

5. The weight bar of claim 2, wherein the transverse wall has a first side and a second side with the first and second walls extending beyond both sides of the transverse wall.

6. The weight bar of claim 1, wherein said first bar segment and said second bar segment are integral.

7. The weight bar of claim 1, wherein said first and second bar segments of the weight bar are spaced apart and have a third bar segment extending therebetween.

8. The weight bar of claim 7, wherein the third bar segment includes a first bar stacked on the first legs of the first and second bar segments and a second bar stacked on the second legs of the first and second bar segments thereby defining an open area between ends of the first and second segments.

9. The weight bar of claim 7, wherein the one or more selectively adjustable handles includes at least two spaced apart handles with a first handle disposed along the first bar segment and a second handle disposed along the second bar segment.

10. The weight bar of claim 7, wherein the one or more selectively adjustable handles includes at least two spaced apart handles disposed along the third bar segment.

11. The weight bar of claim 1, wherein the one or more selectively adjustable handles includes at least two spaced apart handles with a first handle disposed along the first bar segment and a second handle disposed along the second bar segment.

12. The weight bar of claim 11, wherein the one or more selectively adjustable handles are disposed along the first and second bar segments and the third bar segments.

13. The weight bar of claim 1, wherein coupling members are linked along both the first end of each of the one or more selectively adjustable handles and the second end of each of the one or more selectively adjustable handles making each handle selectively repositionable along the first leg or the second leg or along both first and second legs.

14. A multi-purpose weight bar, comprising:

an oblong body including:

a first substantially u-shaped bar segment including a first leg, a second leg spaced apart from said first leg and a transverse cross member connected to said first and second legs, said transverse cross member including a weight support member extending outwardly therefrom;

a second substantially u-shaped bar segment including a first leg, a second leg spaced apart from said first leg and a transverse cross member connected to said first and second legs, said transverse cross member including a weight support member extending outwardly therefrom; and a third bar segment including a first leg disposed parallel to and connected to the first legs of said first and second bar segments and a second leg disposed parallel to and connected to the second legs of said first and second bar segments to define an open area between ends of the first and second legs of said first and second bar segments adjacent to the third bar segment;

at least two spaced apart selectively repositionable handles disposed along at least one of said first, second or third bar segments wherein said handles extend between the first and second legs of a bar segment; and each of the handles having a coupling member including a pivotable panel connected to at least one end of a respective handle and a selectively releasable latch assembly extending from said panel connected to a respective first or second leg of one of said first, second or third bar segments, wherein said latch assembly includes a shaft having a first end connected to said panel and a central portion, a spring disposed over the shaft, and a displaceable knob extending through a slot, disposed over the spring and shaft.

15. The weight bar of claim 14, wherein each of the first and second legs include a top wall, a bottom wall, and a transverse wall collectively defining an elongated recess, said transverse wall including one or more slots for hosting the respective releasable latch assembly.

16. The weight bar of claim 15, wherein the slot includes a plurality of spaced apart notches expanding portions of the slot whereby upon displacing the knob the shaft can be moved along the slot and upon releasing the knob a portion of the knob seats within a notch to lock the handle in place relative to the weight bar.

17. The weight bar of claim 16, wherein the transverse wall has a first side and a second side with the first and second walls extending beyond both sides of the transverse wall.

18. The weight bar of claim 16, wherein the at least two spaced apart selectively repositionable handles are disposed along the first and second bar segments and the third bar segments.

19. The weight bar of claim 16, wherein coupling members are linked along both the first end of the at least two spaced apart selectively repositionable handles and the second end of the at least two spaced apart selectively repositionable handles making each handle selectively repositionable along the first leg or the second leg or along both first and second legs.

* * * * *